US008210238B2

(12) United States Patent
Cho et al.

(10) Patent No.: US 8,210,238 B2
(45) Date of Patent: Jul. 3, 2012

(54) CONTINUOUS CASTING MACHINE AND METHOD USING MOLTEN MOLD FLUX

(75) Inventors: Jung Wook Cho, Pohang-Si (KR); Hyun Seok Jeong, Pohang-Si (KR); Jong Min Park, Pohang-Si (KR); Goo Hwa Kim, Pohang-Si (KR); Oh Duck Kwon, Pohang-Si (KR); Joong Kil Park, Pohang-Si (KR); Soon Kyu Lee, Pohang-Si (KR); Sang Ho Lee, Pohang-Si (KR); Ki Hyeon Moon, Pohang-Si (KR)

(73) Assignee: Posco, Pohang-si (KR)

( * ) Notice: Subject to any disclaimer, the term of this patent is extended or adjusted under 35 U.S.C. 154(b) by 241 days.

(21) Appl. No.: 12/306,216

(22) PCT Filed: Jun. 22, 2007

(86) PCT No.: PCT/KR2007/003035

§ 371 (c)(1),
(2), (4) Date: Dec. 22, 2008

(87) PCT Pub. No.: WO2007/148941

PCT Pub. Date: Dec. 27, 2007

(65) Prior Publication Data

US 2009/0165987 A1 Jul. 2, 2009

(30) Foreign Application Priority Data

Jun. 23, 2006 (KR) ..... 10-2006-0056666

(51) Int. Cl.
*B22D 11/00* (2006.01)
*B22D 11/108* (2006.01)

(52) U.S. Cl. ..... 164/473; 164/268

(58) Field of Classification Search ..... 164/415, 164/473, 475, 268
See application file for complete search history.

(56) References Cited

U.S. PATENT DOCUMENTS 4,729,421 A 3/1988 Schatz
(Continued)

FOREIGN PATENT DOCUMENTS

EP 0 759 415 A1 2/1997
(Continued)

OTHER PUBLICATIONS

English-language translation of JP 49-105727, 9 pages, Oct. 7, 1974.
(Continued)

*Primary Examiner* — Kevin P Kerns
(74) *Attorney, Agent, or Firm* — Finnegan, Henderson, Farabow, Garrett & Dunner, L.L.P.

(57) ABSTRACT

A continuous casting machine and method using molten mold flux, wherein the continuous casting machine includes a mold cover for covering an upper portion of a mold; a mold flux melting unit for melting mold flux to be supplied into the mold; and a mold flux delivery unit for supplying the mold with the molten mold flux melted in the mold flux melting unit, wherein the delivery unit includes an injection tube with one end connected to the mold flux melting unit and the other end positioned in the mold through the mold cover, and an injection tube heater for heating the injection tube. Since a slag bear continuous casting machine and method using molten mold flux is removed, the consumption of mold flux is greatly increased compared with the case of a conventional casting work, so that the friction between a mold and a solidified shell is reduced. As a result, an amount of scarfing of a cast piece is greatly reduced and no carbon pick-up occurs.

8 Claims, 3 Drawing Sheets

U.S. PATENT DOCUMENTS 5,577,545 A 11/1996 Backerud

FOREIGN PATENT DOCUMENTS

| | | |
|---|---|---|
| JP | 49-105727 | 10/1974 |
| JP | 62-081252 | 4/1987 |
| JP | 62-81252 | 4/1987 |
| JP | 01-202349 | 8/1989 |
| JP | 4-105757 | 4/1992 |
| JP | 05-023802 | 2/1993 |
| JP | 05-146855 | 6/1993 |
| JP | 06-007907 | 1/1994 |
| JP | 06-007908 | 1/1994 |
| JP | 06-047511 | 2/1994 |
| JP | 06-079419 | 3/1994 |
| JP | 06-154977 | 6/1994 |
| JP | 06-226111 | 8/1994 |
| JP | 8-66752 | 3/1996 |
| JP | 8-187558 | 7/1996 |
| JP | 11-254126 | 9/1999 |
| JP | 2000-312953 | 11/2000 |
| JP | 2002-0051470 | 6/2002 |
| JP | 2002-239692 | 8/2002 |
| JP | 2004-009064 | 1/2004 |
| JP | 2004-82190 | 3/2004 |
| JP | 2004-141919 | 5/2004 |
| KR | 1996-0000325 | 1/1996 |
| KR | 10-1998-038065 | 8/1998 |
| KR | 2002-0052622 | 7/2002 |
| KR | 10-0354314 | 9/2002 |
| KR | 2003-44718 A | 6/2003 |

OTHER PUBLICATIONS

Extended European Search Report, mailed Mar. 30, 2012, for European Patent Application No. 12151045.7 (7 pages).

[Fig. 1]
Prior Art
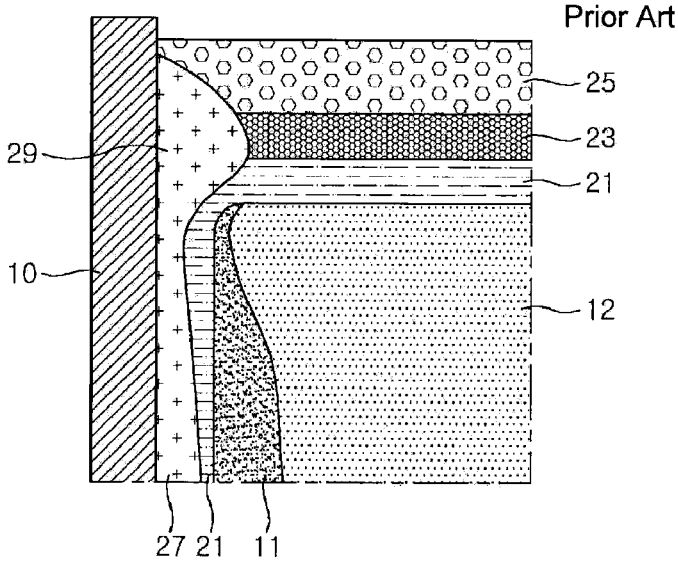
[Fig. 2]
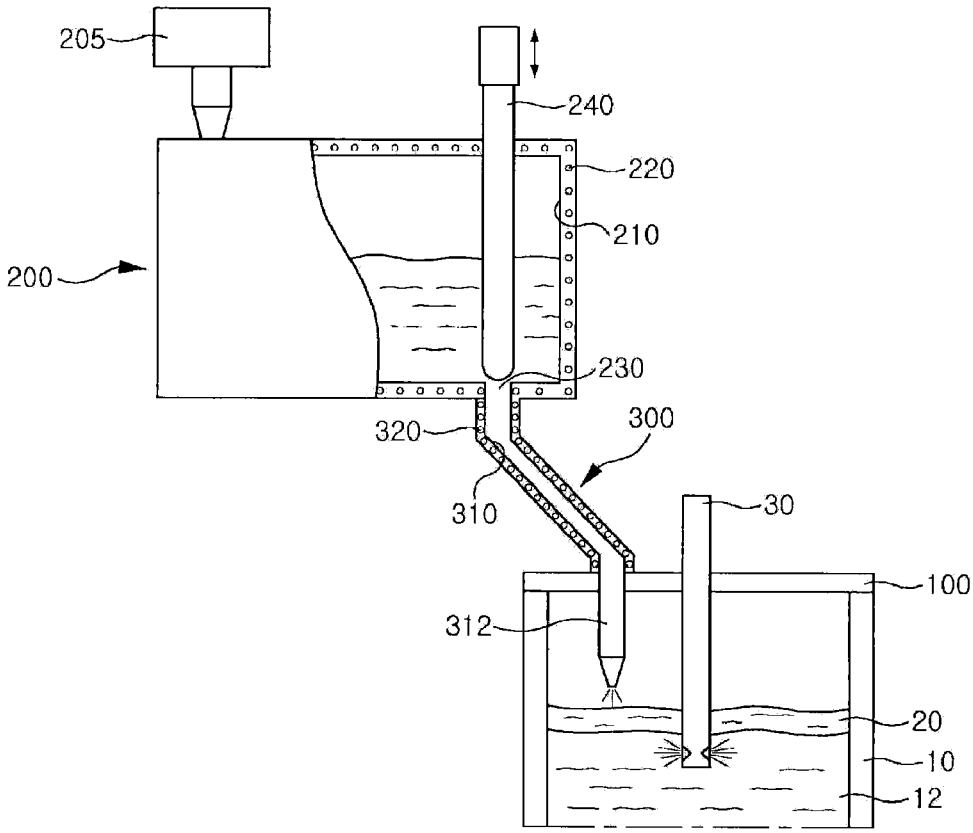

[Fig. 3]
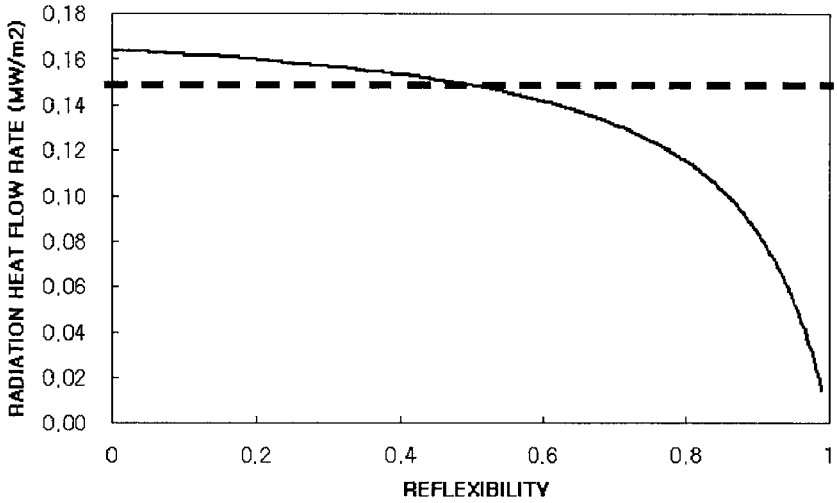
[Fig. 4]
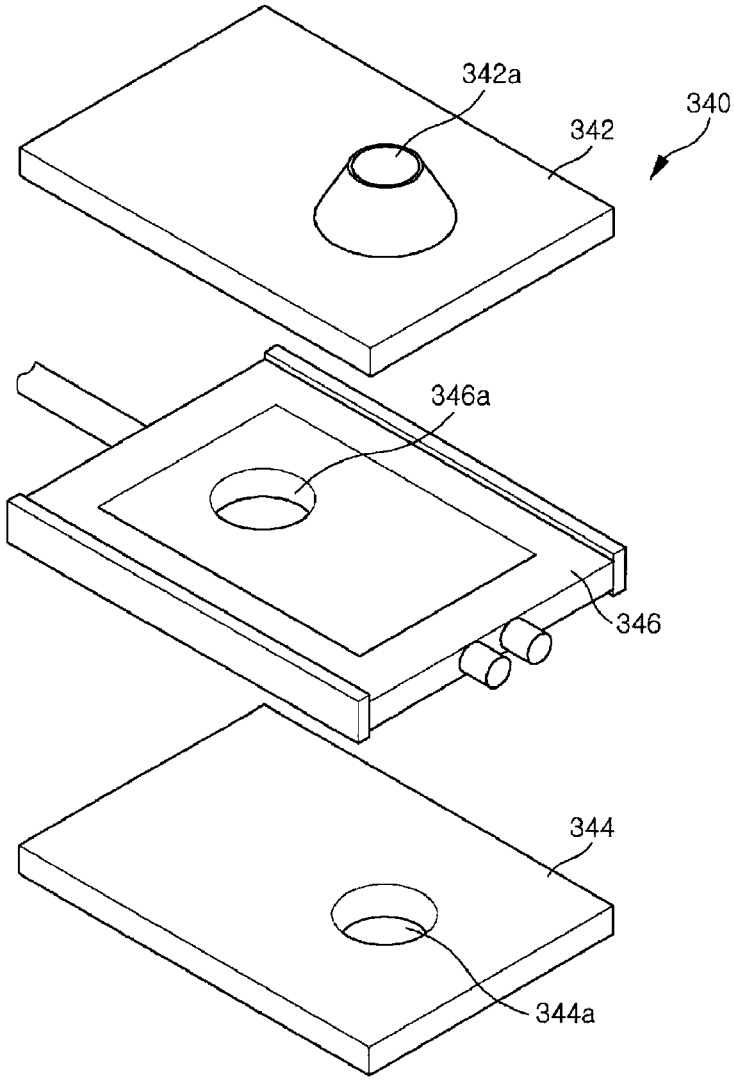

[Fig. 5]
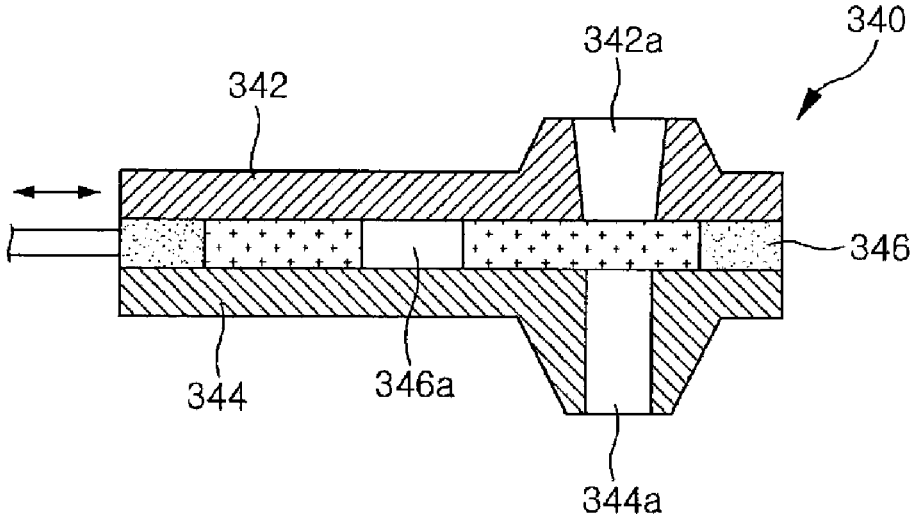
[Fig. 6]
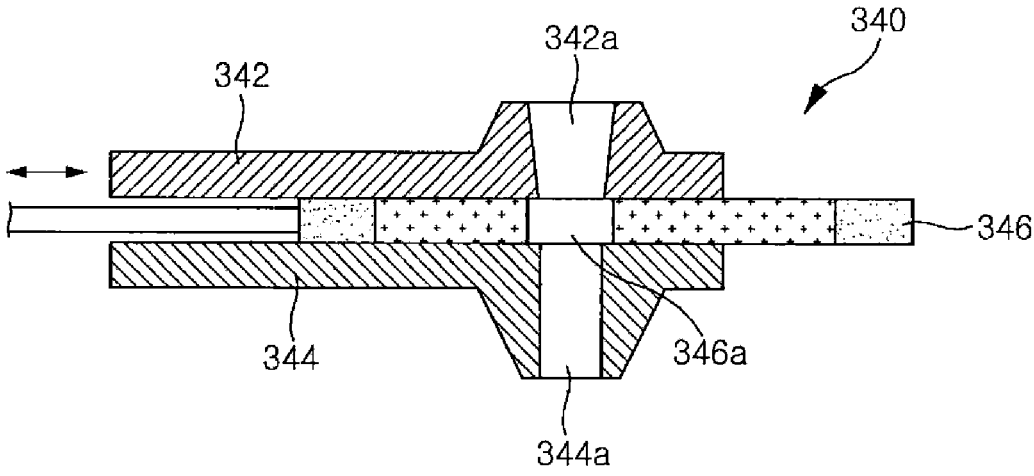

CONTINUOUS CASTING MACHINE AND METHOD USING MOLTEN MOLD FLUX

CROSS REFERENCE TO RELATED APPLICATIONS

This application is a national phase application based on international application number PCT/KR2007/003035, filed Jun. 22, 2007, and claims priority of Korean Patent Application No. 10-2006-0056666, filed Jun. 23, 2006, the content of both of which is incorporated herein by reference.

TECHNICAL FIELD

The present invention relates to a continuous casting machine and method using molten mold flux, and more particularly, to a continuous casting machine and method using molten mold flux, in which the mold flux is injected in a liquid state to a surface of a molten steel in a continuous casting mold throughout the entire period of the continuous casting after the mold flux to be supplied is melted in advance outside the mold.

BACKGROUND ART

Generally, in order to fabricate a cast piece (which is the general term for slab, billet, bloom, beam blank and the like) in a continuous casting machine, molten steel in a liquid state supplied from a ladle passes through a mold via a tundish that stores the molten steel, and then a solidified shell in a solid state is formed by means of a cooling operation in the mold. While the solidified shell obtained by cooling the molten steel is guided by a guide rolls installed below it, the solidified shell is solidified by a secondary cooling water sprayed by spray nozzles, thereby becoming a cast piece in a complete solid state.

During the continuous casting work of steel, mold flux as a subsidiary material as well as molten steel is input into the mold together when the molten steel is supplied into the mold. The mold flux is generally input in a solid state, such as powder or granule, and is melted by heat generated in the molten steel supplied into the mold, thereby controlling heat transfer between the molten steel and the mold and improving the lubricating ability.

As shown in FIG. 1, the mold flux input into the mold in the shape of powder or granule is melted on an upper surface of the molten steel 12 to form a liquid layer 21, a sintering layer (or semisolid layer) 23 and a powder layer 25 in order from the molten steel surface. The liquid layer 21 is substantially transparent, so that a radiant wave with a wavelength of 500 to 4,000 nm emitted from the molten steel can be easily transmitted through the liquid layer 21. On the other hand, the sintering and powder layers 23 and 25 are optically opaque, thereby blocking a radiant wave and thus preventing a rapid decrease of temperature of the molten steel surface.

However, after the conventional mold flux in the shape of powder or granule is melted by the heat of the molten steel, the liquid layer 21 flows between the mold 10 and the solidification layer 11, thereby being solidified on an inner wall surface of the mold 10 to form a solid slag film 27 and also forming a liquid slag film on the molten steel side to control heat transfer between the molten steel and the mold and improve the lubricating ability.

At this time, at the point where the molten slag begins to flow between the solid slag film 27 and the solidified shell 11, the mold flux adhering to the mold is formed to protrude to the inside of the mold. This portion is referred to as a slag bear 29.

The slag bear 29 prevents the molten slag from being introduced between the mold flux film 27 and the solidified shell 11.

This slag bear 29 restricts consumption of mold flux per unit area of a cast piece. Generally, the consumption of mold flux decreases as a casting speed increases, so that the lubricating ability between the cast piece and the mold is deteriorated to thereby increase frequency of occurrence of break-out. In addition, since the thickness of the liquid layer of mold flux becomes irregular due to the slag bear 29, the shape of the solidified shell 11 in the mold 10 becomes irregular, thereby causing surface cracks, which is also more serious as a casting speed is increased.

In this regards, Korean laid-open Patent Publication No. 1998-038065 and U.S. Pat. No. 5,577,545 disclose a method for restraining growth of the slag bear by lowering the melting speed of mold flux by coating mold flux with graphite or fine carbon black. However, this method cannot prevent a slag bear fundamentally. In addition, when the melting speed of mold flux is low, the mold flux in an un-molten state is introduced between the solidified shell and the mold, which causes irregularity of the solidification and also increases break-out defects.

In order to solve the above problem, Japanese Laid-open Patent Publication No. 1989-202349, 1993-023802, 1993-146855, 1994-007907, 1994-007908, 1994-047511, 1994-079419, 1994-154977 and 1994-226111 disclose a method for melting mold flux at the outside of a mold and then injecting it through a molten steel surface. However, the aforementioned documents suggest that the mold flux in a molten state is limitedly used only in an initial casting process, and then, once the casting work reaches a normal state, mold flux in the shape of powder is used to return to the conventional operation. As mentioned above, since the mold flux in a molten state is substantially transparent in a wavelength of 500 to 4,000 nm, a radiant wave emitted from the molten steel may easily pass through the mold flux, so that the surface of the molten steel cannot be kept at a set temperature due to the increased radiant heat transfer. Accordingly, if the casting is progressed for a certain time, the surface of the molten steel may be solidified, which would be an obstacle in performing the continuous casting process.

In addition, paper has been used to supply the mold flux in a molten state into the mold. However, the paper has a limit in supplying the mold flux in a molten state throughout the entire period of the continuous casting process.

DISCLOSURE OF INVENTION

Technical Problem

Accordingly, the present invention is conceived to solve the aforementioned problems in the aforementioned prior art. There is provided in the present invention a continuous casting machine and method, wherein mold flux in a molten state can be injected into a mold throughout the entire period of a continuous casting process.

Technical Solution

A continuous casting machine according to the present invention includes a mold cover for covering an upper portion of a mold; a mold flux melting unit for melting mold flux to be supplied into the mold; and a mold flux delivery unit for supplying the mold with the molten mold flux melted in the mold flux melting unit, wherein the delivery unit includes an injection tube with one end connected to the mold flux melting unit and the other end positioned in the mold through the mold cover, and an injection tube heater for heating the injection tube.

Here, the injection tube heater may include a heating wire arranged around the injection tube.

In addition, a stopper is provided to a discharge port, which the injection tube of the delivery unit is connected to and the molten mold flux is discharged through, being movable toward the discharge port, whereby a gap between one end of the stopper and the discharge port is controlled as the stopper moves. Alternatively, an injection flow rate may also be controlled by means of a sliding gate instead of the stopper.

That is, the continuous casting machine may further include a sliding gate including: an upper plate having an inflow through hole formed therein; a lower plate having an outflow through hole formed therein; and an opening/closing plate being slidable between the upper and lower plates and having a communication hole formed therein, wherein the sliding gate may be installed to the injection tube. At this time, the sliding gate may be installed adjacent to the mold cover.

In addition, at least the injection tube and a portion connected or contacted thereto may include platinum or its alloy.

Further, an inner surface of the mold cover may have a reflectivity of 50% or more with respect to infrared rays.

A continuous casting method according to the present invention includes: melting mold flux at the outside of a mold; inputting the molten mold flux into the mold throughout an entire continuous casting process with a flow rate of the molten mold flux controlled; and blocking radiant heat from molten steel, wherein the molten mold flux is heated to keep a constant temperature until the mold flux is input into the mold after being molten.

A material used in the mold flux melting step may contain free carbon of 1 wt % or less.

In addition, when an amount of supplied molten steel is in a range of 1 to 5 ton/min, a flow rate of the molten mold flux may be controlled to be in a range of 0.5 to 5 kg/ min.

Further, the molten mold flux may be kept in a temperature range lower than a liquidus temperature of molten steel by 100 to 300° C.

Advantageous Effects

As described above, in the present invention, as a slag bear is removed, a consumption of mold flux is greatly increased compared with a case of a conventional casting work, so that the friction between a mold and a solidified shell is reduced. Accordingly, oscillation marks and hooks are reduced, and an amount of scarfing of a cast piece is also reduced. In particular, under the condition that an oscillation stroke is decreased and a negative strip ratio is reduced compared with a case of the conventional work, the depth of oscillation mark is excellently reduced.

Furthermore, since free carbon is not contained in molten mold flux, no carbon pick-up occurs. Also, owing to slow cooling at initial solidification, it is possible to prevent various crack defects such as a vertical crack, a horizontal crack and a corner crack on a surface of the cast piece. In addition, since mold flux in a powder state is not used, the casting environment is improved due to no dust generation, and cooling water in continuous casting can also be prevented from being turbid due to non-molten dust.

BRIEF DESCRIPTION OF THE DRAWINGS

FIG. 1 is a sectional view of a mold when a conventional continuous casting work is performed;

FIG. 2 is a schematic view of a continuous casting machine using molten mold flux according to the present invention;

FIG. 3 is a graph showing a flow rate of radiant heat in a molten steel surface in the mold according to a reflectivity of an inner surface of a mold cover of the continuous casting machine according to the present invention;

FIG. 4 is an exploded perspective view of a sliding gate applied to the continuous casting machine according to the present invention;

FIGS. 5 and 6 are sectional views illustrating the operation of the sliding gate applied to the present invention.

BEST MODE FOR CARRYING OUT THE INVENTION

Hereinafter, preferred embodiments of the present invention will be described in detail with reference to the accompanying drawings. However, the present invention is not limited to the embodiments disclosed below but may be implemented into different forms. These embodiments are provided only for illustrative purposes and for full understanding of the scope of the present invention by those skilled in the art. Throughout the drawings, like reference numerals are used to designate like elements.

FIG. 2 is a schematic view showing a continuous casting machine according to the present invention. The continuous casting machine of the present invention includes a mold 10, an immersion nozzle 30 for supplying molten steel into the mold 10, a mold cover 100 for covering an upper portion of the mold 10, a mold flux melting unit 200 for melting mold flux to be supplied into the mold, and a mold flux delivery unit 300 for supplying the mold 10 with molten mold flux 20 that was molten in the mold flux melting unit 200.

In the above configuration, the mold 10 and the immersion nozzle 30 are general configurations applied to a conventional continuous casting machine, so that a description thereof will be omitted herein.

The mold cover 100 is installed to an upper surface of the mold 10 in order to cover the entire molten steel surface, thereby preventing the radiant heat emitted from the surface of the molten steel 12 from being transferred to the outside. To this end, an inner surface of the mold cover 100, namely a surface facing the molten steel, is made of a material with a high reflectivity, such as an aluminum mirror or a gold-coated mirror, to reflect the radiant wave emitted from the surface of the molten steel 12 and then allow the surface of the molten steel 12 or the molten mold flux 20 to absorb the radiant heat again. Accordingly, it is possible to minimize a temperature drop of the surface of the molten steel 12 and at the same time to prevent the molten mold flux 20 from being solidified again on the wall surface of the mold 10.

The mold flux melting unit 200 includes a mold flux supplier 205, a crucible 210 for receiving a mold flux material in a provisionally melted liquid state or a granular or powder state from the mold flux supplier 205, a mold flux heater 220 such as a heating wire provided around the crucible 210 to melt the mold flux, a discharge port 230 for discharging the molten mold flux melted into a desired state in the crucible 210, and a stopper 240 for opening or closing the discharge port 230 to control an amount of discharged molten mold flux. The stopper 240 vertically moves at a position over the discharge port 230 and thus adjusts a distance between an edge of the discharge port 230 and a lower end of the stopper 240, thereby controlling an amount of the discharged molten mold flux. At this time, the stopper 240 is precisely controlled for its vertical movement by means of a pneumatic or hydraulic cylinder (not shown).

The delivery unit 300 includes an injection tube 310 having one end connected to the mold flux melting unit 200 and the other end provided with an injection nozzle 312 for supplying the molten mold flux 20 into the mold through the mold cover 100, and an injection tube heater 320 surrounding the outside of the injection tube 310 between the mold flux melting unit 200 and the mold cover 100 to heat the injection tube 310. At this time, in order to keep the molten mold flux 20 at a constant temperature, the outside of the injection tube 310 and the injection tube heater 320 is preferably insulated by an insulating material.

In the aforementioned configuration, the mold cover 100 is an essential component for performing the continuous casting work using molten mold flux throughout the entire process period. It was found that when the molten mold flux 20 is injected into the mold, a heat loss in the molten steel surface is larger rather than a case using conventional mold flux in a powder state if a flow rate of radiant heat of the molten steel is 0.15 $Mw/m^2$ or more. Referring to FIG. 3 showing a change of a flow rate of radiant heat according to reflectivity based on the above, it was found that a heat loss in the molten steel surface is larger rather than a case of the conventional work using powder mold flux, when the reflectivity of the molten steel with respect to IR ray, i.e., radiant wave, is less than 50%. Thus, the inner surface of the mold cover 100, i.e., the surface facing the molten steel, is made of a material, such as aluminum, copper and gold, with an excellent reflecting efficiency with respect to the radiant heat of the molten steel, and at the same time, the surface is designed to have a surface roughness of a suitable level so that the reflectivity of the inner surface is 50% or more. That is, the inner surface of the mold cover 100 is maintained to have the average reflectivity of at least 50% with respect to IR ray in a range of 500 to 4,000 nm, thereby keeping the molten steel surface at a set temperature during the casting work and thus performing the casting work using molten mold flux smoothly during the entire casting period.

Meanwhile, in the mold flux loaded into the crucible 210, a carbon component, such as graphite or carbon black (hereinafter, referred to as free carbon in order to be distinguished from carbon in the form of carbonate) is limited to 1 wt % or less. This is because free carbon is not required in the casting work of the present invention. The conventional work using powder shaped mold flux necessarily includes free carbon of 1 wt % or more so as to prevent a slag bear from being formed. However, the present invention need not add free carbon since the mold flux in a molten state is injected and thus no slag bear is formed. Thus, it is preferred that no free carbon is contained. However, even though free carbon of 1 wt % or less is added as impurities, it is oxidized during the mold flux melting process and then removed in a gas state, so that no free carbon exists in the molten mold flux.

The mold flux melting unit 200 and the delivery unit 300 are partially or entirely made of platinum (Pt) or its alloy such as platinum-rhodium (Pt—Rh). The mold flux should rapidly melt nonmetallic inclusions rising to the molten steel surface in the mold during the casting process, thereby having low viscosity and rapidly melting oxides such as $Al_2O_3$. Thus, a furnace of refractory material used in the existing glass industry has a problem of being rapidly corroded by the molten mold flux 20. In particular, when corrosion occurs on the discharge port 230 for discharging the molten mold flux 20 from the mold flux melting unit 200, the lower end of the stopper 240, and the injection tube 310 including the injection nozzle 312 of the mold flux delivery unit 300, it is impossible to precisely control the flow rate of the molten mold flux, thereby making it impossible to perform the continuous casting work stably. Accordingly, in the present invention, at least the injection tube 310 and a portion which is connected to or in contact with the injection tube, i.e., the discharge port 230 for discharging the molten mold flux, the stopper 240 and the injection tube 310 are preferably made of platinum or its alloy to prevent corrosion caused by the mold flux. Although in addition to platinum or its alloy, high heat-resisting graphite or nickel alloy is not corroded by the molten mold flux, it is hardly maintained at a high temperature of 1,300° C. or more for a long time, and thus is not appropriate for the successive continuous casting work.

In addition, in the aforementioned configuration, the flow rate of the molten mold flux is changed depending on an amount of molten steel supplied into the mold per a unit time. When an amount of the supplied molten steel is in the range of 1 to 5 ton/min, an amount of the molten mold flux is in the range of 0.5 to 5 kg/min. Thus, in order to successively inject the molten mold flux 20 throughout the entire period of the continuous casting process, such a low flow rate should be precisely controlled. That is, molten mold flux was conventionally injected using a tilting method or a siphon method utilizing a pressure difference. These methods are easy in injecting a large amount of mold flux to the molten steel surface but unsuitable for precisely controlling a flow rate of molten mold flux in the range of 0.5 to 5 kg/min so as to accomplish the object of the present invention. In particular, the conventional methods are not appropriate to instantly controlling the flow rate while observing the molten steel surface and checking a thickness of the mold flux which covers the molten steel surface, in real time. Thus, regarding the injection of the molten mold flux in the present invention, the stopper 240 is vertically moved as shown in FIG. 2 to control a gap between the lower end of the stopper 240 and the edge of the discharge port 230, whereby it is possible to precisely control a low flow rate of the molten mold flux 20.

Meanwhile, the flow rate control of the molten mold flux 20 may also be implemented using a sliding gate shown in FIGS. 4, 5 and 6, instead of the stopper 240 shown in FIG. 2. Referring to FIGS. 4, 5 and 6, a sliding gate 340 for controlling a flow rate of the molten mold flux 20 supplied from the mold flux melting unit 200 includes an upper plate 342 coupled to the discharge port 230 of the mold flux melting unit 200 and formed with an inflow through hole **342*a* communicating with the discharge port 230, a lower plate coupled to one end of the delivery unit 300 and formed with an outflow through hole 344*a* communicating with the injection tube 310 of the delivery unit 300, an opening/closing plate 346 slidably installed between the upper plate 342 and the lower plate 344 and formed with a communication hole 346*a*, and a pneumatic or hydraulic cylinder (not shown) for laterally moving the opening/closing plate 346. In the sliding gate 340 configured as above, the opening/closing plate 346 moves between a closing position shown in FIG. 5 and an opening position shown in FIG. 6, so that the communication hole 346*a* of the opening/closing plate 346 controls an opening size of the inflow through hole 342*a* and the outflow through hole 344*a*. Thus, a flow rate of the molten mold flux 20 passing therethrough is controlled. At this time, a portion of the sliding gate 340** which is brought into direct contact with the molten mold flux is preferably made of platinum or its alloy due to the aforementioned reasons.

Although the aforementioned sliding gate 340 is installed between the mold flux melting unit 200 and the injection tube 310 of the delivery unit 300, it may be installed at any position in the middle of the injection tube 310, or a position adjacent to the mold cover 100, i.e., right above the mold cover 100. In this case, since a flow rate of the molten mold flux 20 is controlled just before the molten mold flux 20 is introduced into the mold 10, it is possible to more accurately supply a desired amount of the molten mold flux 20 into the mold 10. This is because, although the delivery unit 300 keeps the molten mold flux 20 at a desired temperature, a flow rate of the molten mold flux 20 actually supplied into the mold 10 may be changed due to a state change of the molten mold flux 20 of high temperature while flowing in the delivery unit 300 with a long length.

When the molten mold flux 20 is supplied into the mold 10 from the mold flux melting unit 200, the delivery unit 300 should keep the molten mold flux 20 at a constant temperature. To this end, the injection tube heater 320 such as a heating wire is provided around the injection tube 310 of the delivery unit 300.

This is because the molten mold flux supplied into the mold should be kept at a temperature range lower than a liquidus temperature by 100 to 300° C. If the molten mold flux is below such a temperature range, the temperature of the molten steel may be instantly dropped to thereby solidify the molten steel surface. If the molten mold flux is above such a temperature range, solidification of the molten steel may be seriously delayed on the wall of the mold. For example, in a case of general ultra low carbon steel with a carbon concentration of 60 ppm and a liquidus temperature of 1,530° C., the molten mold flux should have a temperature in a range of 1,230 to 1,430° C.

Thus, while the molten mold flux 20 flows in the delivery unit 300, the injection tube heater 320 keeps the molten mold flux 20 in a temperature range lower than a liquidus temperature of the molten steel by 100 to 300° C. In this way, when the molten mold flux is supplied to the molten steel surface, the molten steel is not excessively cooled or solidification of the molten steel is not delayed on the wall of the mold, as mentioned above. In addition, viscosity of the molten mold flux is maintained, and the molten mold flux is not cooled or even partially solidified, so that the molten mold flux can be injected into the mold during the continuous casting process by precisely controlling the molten mold flux at a low flow rate in a range of 0.5 to 5 kg/min.

Hereinafter, a specific example of the present invention will be explained in more detail using comparative examples according to a prior art.

Example According to the Present Invention

Using the continuous casting machine using molten mold flux according to the present invention, a slab casting process was performed with a mold having a lower end width of 1,012 mm and a thickness of 100 mm. The kind of steel was ultra low carbon steel with a carbon concentration of 60 ppm. The used mold flux was commercially applicable to casting ultra low carbon steel, and free carbon was not detected in a molten state within an analysis error range. After the mold flux was completely melted outside the mold, the molten mold flux 20 was injected into the mold 10 using a flow rate control unit such as the stopper 240. When being injected, the molten mold flux 20 had a temperature of 1,300° C. At the point when the mold 10 was filled with the molten steel before initiating the casting process, the casting process was initiated and at this time the mold cover 100 was installed to the mold 10 after a molten pool reaches a desired thickness. Thereafter, as the casting process is progressed, the molten mold flux 20 was supplemented as much as it was consumed. The mold cover 100 is formed of an aluminum material and its surface was very lustrously polished. The surface is designed to have an average reflectivity of 85% with respect to IR rays in the range of 500 to 4,000 nm that is a range of radiant wave from molten steel.

Comparative Example According to the Prior Art

Like the above embodiment, a slab casting process for ultra low carbon steel having a carbon concentration of 60 ppm is performed with a mold having a lower end width of 1,012 mm and a thickness of 100 mm. The used mold flux was mold flux in a powder state to which free carbon of 1.5 wt % was added. That is, the mold flux substantially had the same components as the mold flux in a molten state used in the above example, i.e., in a state where free carbon is removed. As in a general casting work using powder mold flux, at the point when the mold is filled with steel before the casting process, the powder mold flux was input into the mold and then the casting process was initiated. Also, during the casting process, the powder mold flux was frequently input and supplemented.

Process conditions and results of the present example and the comparative example are listed in Table 1 as follows.

TABLE 1

| Classification | Present Example | | | | | Comparative Example | | |
|---|---|---|---|---|---|---|---|---|
| Experiment No. | A | B | C | D | E | F | G | H |
| Casting speed (m/min) | 1.0 | 1.3 | 1.6 | 1.6 | 1.6 | 1.0 | 1.3 | 1.6 |
| NSR (%) | 28 | 28 | 28 | 28 | 0 | 28 | 28 | 28 |
| Oscillation stroke (mm) | 5 | 5 | 5 | 3 | 3 | 5 | 5 | 5 |
| Oscillation frequency (cpm) | 100 | 130 | 160 | 266 | 133 | 100 | 130 | 160 |
| Carbon pick-up at 1 mm depth of cast piece (ppm) | 0 | 0 | 0 | 0 | 0 | 24.2 | 19.0 | 21.3 |
| Consumption of mold flux (kg/m$^2$) | 0.61 | 0.57 | 0.54 | 0.47 | 0.38 | 0.30 | 0.28 | 0.25 |
| Oscillation mark depth (mm) | 0.20 | 0.19 | 0.17 | 0.11 | 0.05 | 0.39 | 0.36 | 0.35 |
| Maximum total heat (MW/m$^2$) | | | | 1.98 | | | | 3.39 |
| Average total heat (MW/m$^2$) | | | | 1.41 | | | | 1.58 |
| Ratio of maximum total heat to average total heat | | | | 1.40 | | | | 2.15 |

As seen from Table 1, the continuous casting work using molten mold flux according to the present invention gives the following effects as compared with a conventional continuous casting work using powder mold flux.

That is, since a slag bear is removed, a consumption of mold flux is greatly increased, so that the friction between a mold and a solidified shell is decreased. Since free carbon is not contained in the molten mold flux, a carbon pick-up does not occur. In addition, since the mold cover maximizes a temperature-keeping effect, a depth of oscillation mark is greatly reduced. In particular, under the condition that an oscillation stroke is decreased and a negative strip ratio is reduced compared with the conventional work, the depth of oscillation mark is excellently reduced.

Also, for some of the present examples and the comparative examples, thermocouples were inserted into the mold during the casting process so as to measure total heat at various portions of the mold and then obtain a maximum value, an average value, and a ratio thereof. The respective thermocouples were inserted at points of 3.3, 23.9, 44.6, 65.2, 106.5, 230.4, 354.3, 457.6, 581.5 and 705.4 mm from the meniscus in a casting direction in the centers of inside and outside of a long side in a width direction. At each position, two thermocouples were inserted at distances of 5 mm and 20 mm respectively from a hot face of a mold copper plate in contact with the solidified shell or the molten steel. During the casting process, a total heat was measured at each position using a difference of temperatures respectively measured from the thermocouples, and an average total heat was calculated using total heats. As seen from Table 1, in the case of the casting work using molten mold flux according to the present invention, it would be understood that a ratio of maximum total heat to average total heat lowers as compared with the conventional work using powder mold flux, so that the initial slow cooling is achieved in the present invention. A main cause of the initial slow cooling of the present invention is that a maximum total heat is lowered just below the meniscus. A ratio of peak total heat to average total heat was 2.0 to 2.5 in the conventional work using powder mold flux, while in the casting work according to the present invention, the ratio is greatly lowered to a range of 1.2 to 1.5.

The present invention has been explained based on the embodiments and drawings, but it should be understood that there may be various changes and modifications within the scope of the invention defined in the appended claims by those having ordinary skill in the art.

The invention claimed is:

1. A continuous casting machine comprising:

a mold cover for covering an upper portion of a mold;

a mold flux melting unit for melting mold flux to be supplied into the mold; and a mold flux delivery unit for supplying the mold with the molten mold flux melted in the mold flux melting unit, wherein the mold flux melting unit includes a mold flux supplier, a crucible for receiving a mold flux material from the mold flux supplier, and a mold flux heater provided around the crucible to melt the mold flux, wherein the delivery unit includes an injection tube with one end connected to the mold flux melting unit and the other end positioned in the mold through the mold cover, and an injection tube heater for heating the injection tube, wherein an entire outside portion of the injection tube between the mold flux melting unit and the mold cover is surrounded by the injection tube heater, wherein a portion of the injection tube positioned in the mold is exposed, wherein at least the injection tube and a portion connected or contacted thereto comprise platinum or its alloy, and wherein an inner surface of the mold cover has a reflectivity of 50% or more with respect to infrared rays.

2. The continuous casting machine as claimed in claim 1, wherein the injection tube heater includes a heating wire arranged around the injection tube.

3. The continuous casting machine as claimed in claim 1, wherein a stopper is provided to a discharge port, which the injection tube of the delivery unit is connected to and the molten mold flux is discharged through, being movable toward the discharge port, whereby a gap between one end of the stopper and the discharge port is controlled as the stopper moves.

4. The continuous casting machine as claimed in claim 1, further comprising a sliding gate including an upper plate having an inflow through hole formed therein, a lower plate having an outflow through hole formed therein, and an opening/closing plate being slidable between the upper and lower plates and having a communication hole formed therein, wherein the sliding gate is installed to the injection tube.

5. The continuous casting machine as claimed in claim 4, wherein the sliding gate is installed adjacent to the mold cover.

6. A continuous casting method, comprising:

melting mold flux at the outside of a mold;

supplying molten steel into the mold;

inputting the molten mold flux into the mold throughout an entire continuous casting process with a flow rate of the molten mold flux controlled; and blocking radiant heat from the molten steel, wherein the molten mold flux is heated to a temperature range constantly until the mold flux is input into the mold after being molten, wherein the molten mold flux is kept in a temperature range lower than a liquidus temperature of molten steel by 100 to 300° C. until the mold flux is input into the mold after being molten, and wherein an inner surface of a mold cover for covering the mold has a reflectivity of 50% of more with respect to infrared rays.

7. The continuous casting method as claimed in claim 6, wherein a material used in the mold flux melting step contains free carbon of 1 wt % or less.

8. The continuous casting method as claimed in claim 6, wherein when an amount of supplied molten steel is in the range of 1 to 5 ton/min, a flow rate of the molten mold flux is controlled in the range of 0.5 to 5 kg/min.

* * * * *

UNITED STATES PATENT AND TRADEMARK OFFICE

CERTIFICATE OF CORRECTION

PATENT NO. : 8,210,238 B2
APPLICATION NO. : 12/306216
DATED : July 3, 2012
INVENTOR(S) : Jung Wook Cho et al.

It is certified that error appears in the above-identified patent and that said Letters Patent is hereby corrected as shown below:

In claim 6, column 10, line 48, “of more” should read -- or more --.

Signed and Sealed this
Twenty-seventh Day of November, 2012

David J. Kappos

David J. Kappos
*Director of the United States Patent and Trademark Office*